US007287406B2

(12) United States Patent
Hwang

(10) Patent No.: US 7,287,406 B2
(45) Date of Patent: Oct. 30, 2007

(54) TRANSITION FORMING MACHINE

(75) Inventor: Peter K. Hwang, Kent, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/999,470

(22) Filed: Nov. 30, 2004

(65) Prior Publication Data

US 2006/0117830 A1 Jun. 8, 2006

(51) Int. Cl.
*B21D 39/20* (2006.01)

(52) U.S. Cl. ..... 72/58; 72/370.08; 72/466.8

(58) Field of Classification Search ..... 72/58, 72/354.2, 370.08, 466.8
See application file for complete search history.

(56) References Cited

U.S. PATENT DOCUMENTS

| | | | | |
|---|---|---|---|---|
| 616,764 | A | 12/1898 | Bourke | |
| 2,704,104 | A | 3/1955 | Mueller | |
| 2,971,556 | A * | 2/1961 | Armstrong et al. | 72/42 |
| 3,200,628 | A | 8/1965 | Palkowski et al. | |
| 3,520,163 | A | 7/1970 | Otoda | |
| 3,564,886 | A | 2/1971 | Nakamura | |
| 3,592,034 | A * | 7/1971 | McMeen et al. | 72/58 |
| 3,595,047 | A * | 7/1971 | Fanning et al. | 72/58 |
| 4,006,619 | A | 2/1977 | Anderson | |
| 4,043,160 | A | 8/1977 | Baker et al. | |
| 4,068,372 | A | 1/1978 | Kamohara et al. | |
| 4,109,365 | A | 8/1978 | Tygart | |
| 4,320,568 | A | 3/1982 | Herrod et al. | |
| 4,343,170 | A | 8/1982 | Hufton | |
| 4,422,317 | A | 12/1983 | Mueller | |
| 4,557,128 | A | 12/1985 | Costabile | |
| 4,781,046 | A | 11/1988 | Porowski | |
| 5,233,855 | A | 8/1993 | Maki et al. | |
| 5,419,171 | A | 5/1995 | Bumgarner | |
| 5,823,031 | A * | 10/1998 | Campbell et al. | 72/58 |
| 6,631,759 | B2 | 10/2003 | Cook et al. | |
| 2004/0107754 | A1 | 6/2004 | Frenken | |

FOREIGN PATENT DOCUMENTS

| | | |
|---|---|---|
| DE | 3304467 | 8/1984 |
| JP | 58 173035 | 10/1983 |
| JP | 02 011233 | 1/1990 |

OTHER PUBLICATIONS

Gary Morphy; "Tube Hydroforming Design Flexibility —Part 3"; Apr. 24, 2003.

* cited by examiner

*Primary Examiner*—Daniel C Crane
(74) *Attorney, Agent, or Firm*—Klein, O'Neill & Singh, LLP

(57) ABSTRACT

An apparatus and method including a die assembly and tooling, which includes a draw bolt and coaxially disposed expandable element. When control of the apparatus is initiated the die assembly and draw bolt retract or move down over the work piece until the die assembly is seated in the die holder. The draw bolt continues to move down which causes the elastomer insert to expand and push the work piece outwardly forcing the work piece to conform to the contour of the die assembly creating the desired transition diameter.

10 Claims, 5 Drawing Sheets

TRANSITION FORMING MACHINE

BACKGROUND

1. Field of the Invention

The invention relates to an apparatus and method for forming duct assemblies with complex contours by application of pressure.

2. Related Art

Manufacturers fabricate circular duct assemblies for use in many ducting applications, for example, aircraft environmental control systems (ECS). Some of these assemblies are required to have at least one end expanded to accommodate adjoining ducts. The expansion required can be as much as a half inch from nominal size. Because of the limitations of the current methods of expanding ducts, a separate component with an expanded end must first be fabricated. The detail is welded to another duct section to create the duct assembly.

What is needed is a transition forming apparatus and associated method which enables the formation of duct transitions on a duct assembly thereby eliminating the need for an additional component and the associated welding operation.

SUMMARY

The present invention provides a transition forming apparatus and associated method configured to receive a work piece, such as the end of a duct, and form a transition portion thereon.

In one aspect of the invention, the apparatus includes a die assembly and tooling, which includes a draw bolt and overlapping elastomer insert. The die assembly of the present invention can be a three-segment die assembly as described in greater detail below.

When control of the apparatus is initiated the die assembly and draw bolt retract or move down over the work piece until the die assembly is seated in the die holder. The draw bolt continues to move down which causes the elastomer to expand and push the work piece outwardly forcing the work piece to conform to the contour of the die assembly creating the desired transition diameter.

Once the operation is complete, the draw bolt and die assembly move up away from the die holder which allows the die assembly to be opened to remove the newly formed part.

Beneficially, the apparatus of the present invention provides a repeatable process that eliminates the welding process and reduces cycle time. Since fabrication shops do not need to depend on a supplier for the preformed transition components, throughput times are increased. By eliminating the need for a separate component, the need for welding the transition component to the duct is removed creating a stronger (no weld seam) and less expensive duct assembly.

Additional advantages, objects, and features of the invention will be set forth in part in the detailed description which follows. It is to be understood that both the foregoing general description and the following detailed description are merely exemplary of the invention, and are intended to provide an overview or framework for understanding the nature and character of the invention as it is claimed.

BRIEF DESCRIPTION OF THE DRAWINGS

The accompanying drawings are included to provide further understanding of the invention, illustrate various embodiments of the invention, and together with the description serve to explain the principles and operation of the invention. In the drawings, the same components have the same reference numerals. The illustrated embodiment is intended to illustrate, but not to limit the invention. The drawings include the following Figures.

DETAILED DESCRIPTION

Figure 1:
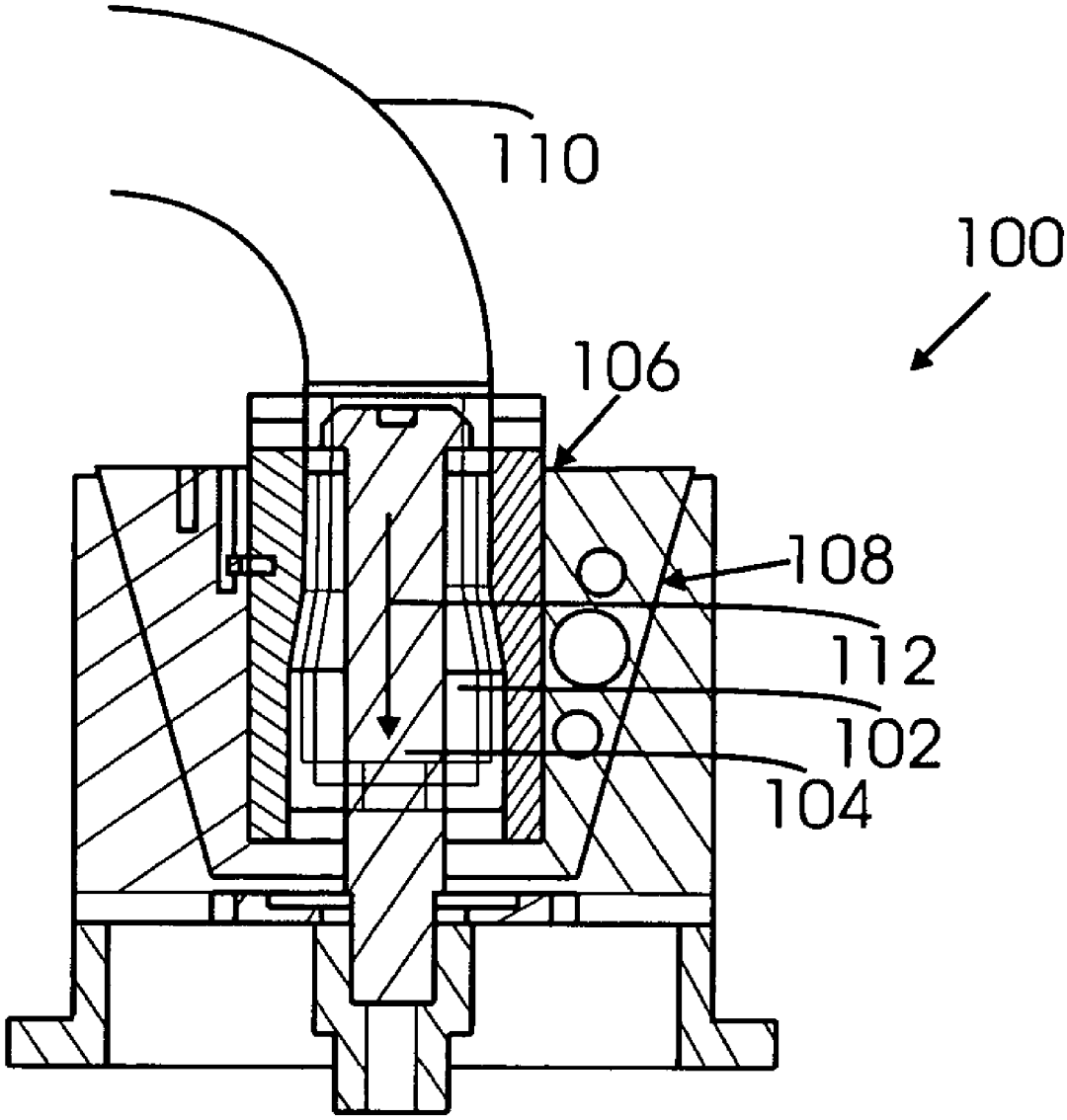
FIG. 1 is a simplified cross-sectional view of a transition forming apparatus in accordance with an embodiment of the present invention.
Figure 2:
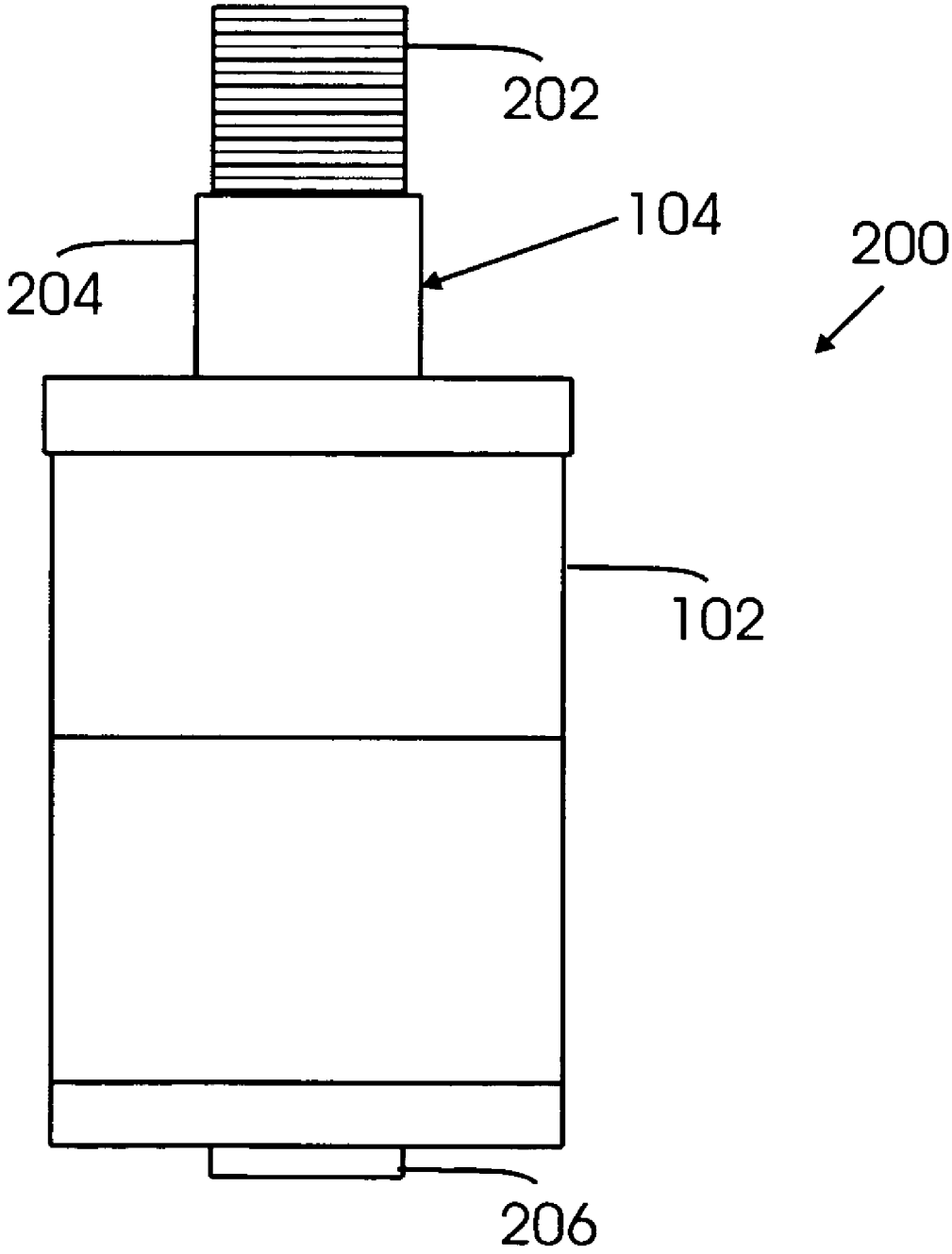
FIG. 2 is a simplified cross-sectional view of an expander-draw bolt assembly in accordance with an embodiment of the present invention.

FIG. 1 is a simplified cross sectional view of a transition forming apparatus 100 including a resilient expandable insert 102 and a draw bolt 104 operationally configured as an expander-draw bolt assembly 200 (hereinafter "expander assembly 200") as shown in FIG. 2.

Referring again to FIG. 1, transition forming apparatus 100 is completed by external components, such as die assembly 106 and die holder 108 configured to surround and hold work piece 110 and guide expander assembly 200 during the transition forming operation.

In one embodiment, transition forming apparatus 100 can include a driving means, such as a hydraulic cylinder (not shown), which is operatively coupled to expander assembly 200. As shown in FIG. 2, the driving means can be coupled via threaded portion 202 on the shank 204 of draw bolt 104. Typically, the hydraulic cylinder includes hydraulic lines through which the ends of the cylinder may be selectively pressurized and vented, to move a piston in either direction in the cylinder and drive expander assembly 200. An integral, enlarged head 206 is formed at the opposite end of draw bolt 104.

Expander 102 can be made of an elastomer. In one embodiment, expander 102 is a thin-walled cylinder, which is made of various hardnesses. To achieve high-quality metal forming results, a plurality of expanders 102 of various heights and hardnesses can be assembled together.

As shown in FIG. 1 a work piece 110 on which a transition section is to be formed is arranged in a telescoping manner over expander assembly 200.

Figure 3A:
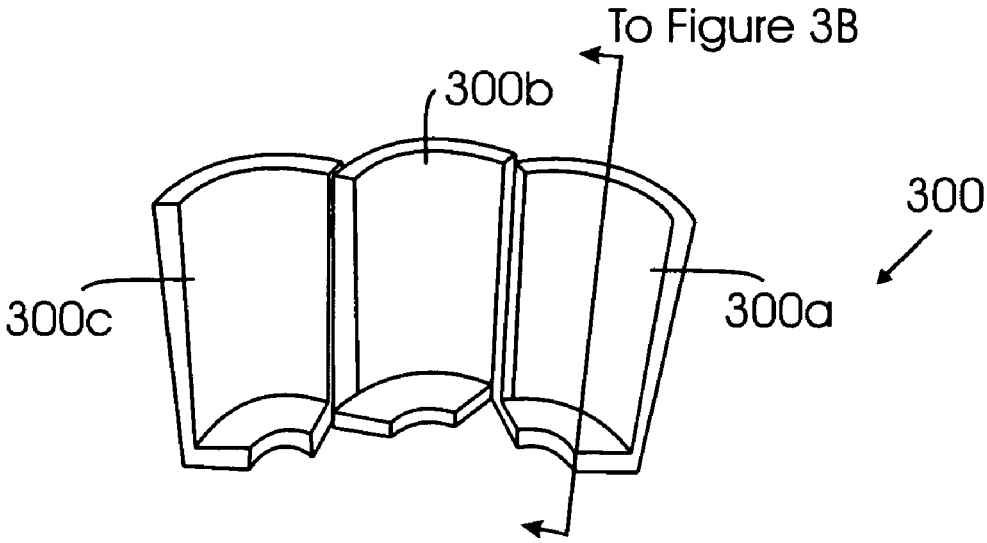
FIG. 3A is a simplified plan view of a split die assembly in accordance with an embodiment of the present invention.

FIG. 3A is a perspective view of die assembly 106. In one embodiment die assembly 106 is a three segment split die assembly 300. Die holder 108 confines split die assembly 300 on work piece 110 after work piece 110 is properly positioned. Die holder 108 also serves to locate work piece 110 end in the proper relationship and prevents expansion of work piece 110 during compression of expander 102.

Figure 3B:
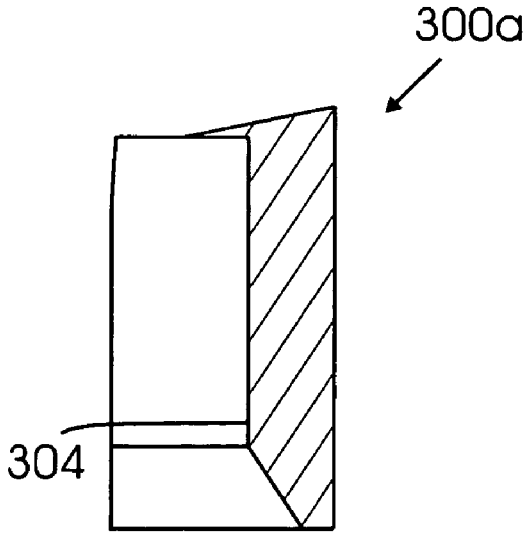
FIG. 3B is a simplified sectional view of a segment of the split die assembly of FIG. 3A in accordance with an embodiment of the present invention.

FIG. 3B is a sectional view of a segment 300*a* of split die assembly 300 which shows the detail of an internal contour of segment 300*a*, which for a given operation, is identical to segments 300*b* and 300*c*. The internal wall 304 of each segment 300*a, b* and *c* can be of any desired contour. The actual shape of the contour depends on the shape and desired transitional diameter desired in each application. In one embodiment, each segment 300*a, b* and *c* has an internal wall 304 which has a transition forming section that expands a small duct to a larger diameter duct.

Figure 4A:
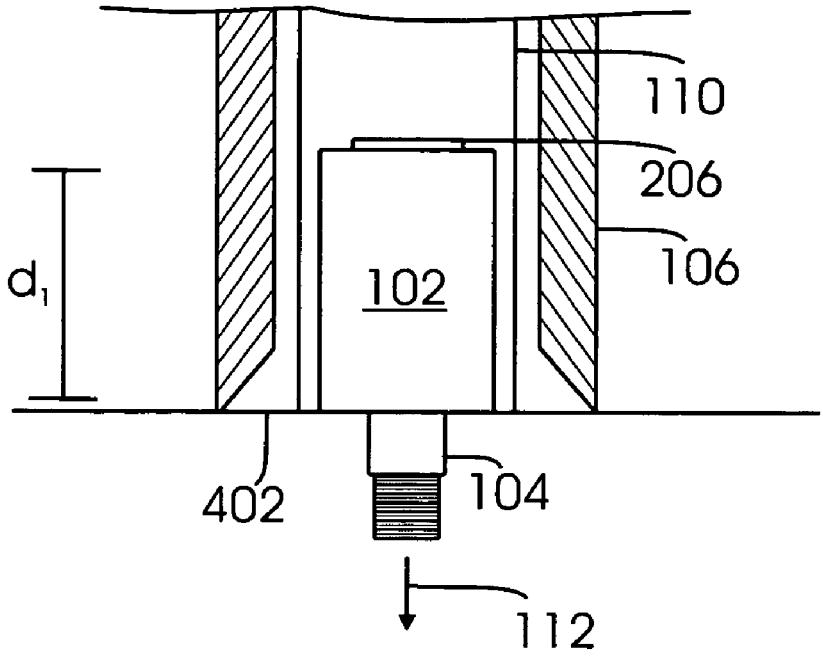
FIGS. 4A, 4B and 4C are simplified sectional views of the transition forming apparatus of FIG. 1 undergoing a transition forming process.

As shown in FIG. 4A, during a transition forming operation, the hydraulic cylinder is pressurized to retract draw bolt 104. Head 206 of draw bolt 104 moves toward the cylinder in the direction of arrow 112 while expander 102 is retained stationary at surface 402 of die holder 108.

Figure 4B:
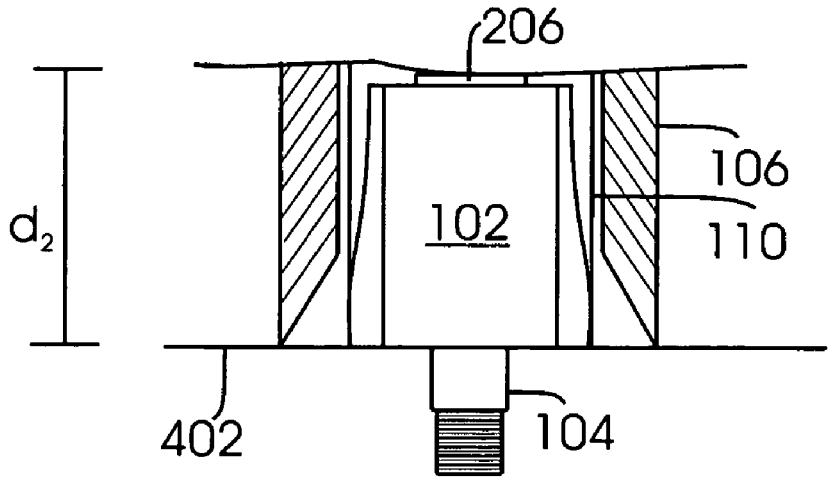

As shown in FIG. 4B, retraction of draw bolt 104 is effective to cause head 206 to compress expander 102, from a first length of $d_1$ to a second length of $d_2$, since expander 102 is held stationary at surface 402. The compression forces the radial outward expansion of expander 102 against the interior of work piece 110.

Figure 4C:
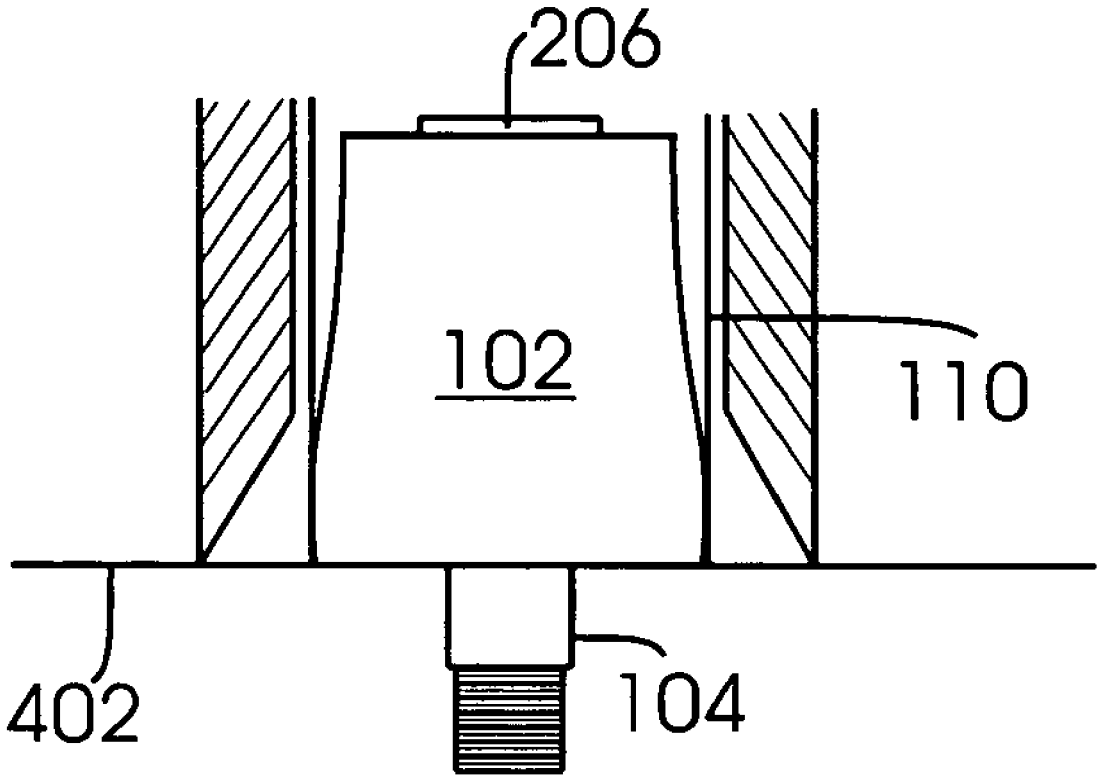

As shown in FIG. 4C, the process is complete when expander 102 has been compressed to the point at which the elastomeric material of expander 102 has filled the contours of split die assembly 300 creating the desired transition diameter.

Once the operation is complete, draw bolt 104 and die assembly 300 move up away from die holder 108 which allows die assembly 300 to be opened to remove the newly formed part.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. An apparatus for forming a transition on a work piece comprising:

a draw bolt having a shank and an enlarged coaxial head located at one end of the shank;

an expandable insert of a resilient material coaxially disposed on the shank adjacent the draw bolt head, said expandable insert including a plurality of expandable portions of variable hardness with the shank inserted through the expandable portions;

a die assembly defining a contoured surface, said draw bolt configured to be retracted to cause said expandable insert to be compressed causing said expandable portions to expand to different diameters to contact sections of a work piece with varying force to force the work piece by the expandable portions against the contoured surface of said die assembly; and a die holder allowing the die assembly to release the formed transition work piece.

2. The apparatus of claim 1, wherein said work piece comprises a tubular duct.

3. The apparatus of claim 1, wherein said die assembly comprises a split die assembly.

4. The apparatus of claim 3, wherein said split die assembly comprises three die elements.

5. The apparatus of claim 1, wherein said die holder is configured to surround and hold said work piece and guide said expandable insert.

6. A method of forming a transition on a work piece comprising:

retracting a draw bolt having a shank and an enlarged coaxial head located at one end of the shank and an expandable insert of a resilient material, said expandable insert including a plurality of expandable portion of varying hardness, coaxially disposed on the shank adjacent the draw bolt head so that the shank is inserted through the plurality of expandable portions and a die assembly defining a contoured surface;

causing said plurality of expandable portions to be stationed within said die assembly while said draw bolt continues to retract causing the expandable portion to expand at different expansion ratios and push sections of a work piece with variable force outwardly causing the work piece to conform to the contour of the die assembly creating a desired transitional transition diameter; and moving the draw bolt and die assembly up away from a die holder allowing the die assembly to open releasing said formed transition work piece from the die assembly.

7. The method of claim 6, wherein said transition diameter comprises a diameter of up to 0.5 inches.

8. The method of claim 6, wherein said work piece comprises a tubular duct.

9. The method of claim 6, wherein said die assembly comprises a split die assembly.

10. The method of claim 9. wherein said split die assembly comprises three die elements.

* * * * *